United States Patent [19]

Silverman

[11] Patent Number: 4,534,855

[45] Date of Patent: Aug. 13, 1985

[54] SHALE OIL DEMETALLIZATION PROCESS

[75] Inventor: Michael A. Silverman, Houston, Tex.

[73] Assignee: Tenneco Oil Company, Houston, Tex.

[21] Appl. No.: 454,740

[22] Filed: Jan. 3, 1983

[51] Int. Cl.[3] ..... C10G 25/00; C10G 45/60

[52] U.S. Cl. ..... 208/253; 208/251 H; 502/415; 502/527

[58] Field of Search ..... 208/253, 251 H, 251 R; 252/477 R; 502/527, 415

[56] References Cited

U.S. PATENT DOCUMENTS

| | | | |
|---|---|---|---|
| 3,365,389 | 1/1968 | Spars et al. | 208/59 |
| 3,674,680 | 7/1972 | Hoekstra et al. | 208/112 |
| 3,857,780 | 12/1974 | Gustafson | 252/477 R |
| 3,947,347 | 3/1976 | Mitchell | 208/251 H |
| 4,046,674 | 9/1977 | Young | 208/251 H |
| 4,181,596 | 1/1980 | Jensen | 208/251 R |
| 4,354,927 | 10/1982 | Shih et al. | 208/251 H |
| 4,411,771 | 10/1983 | Bambrick et al. | 208/254 H |
| 4,447,314 | 5/1984 | Banta | 208/89 |
| 4,486,298 | 12/1984 | Bowes et al. | 208/253 |

*Primary Examiner*—D. E. Gantz
*Assistant Examiner*—Anthony McFarlane
*Attorney, Agent, or Firm*—Kenneth H. Johnson

[57] ABSTRACT

Trace metals, particularly As, Fe and Ni, are removed from hydrocarbonaceous oils, particularly shale oil by contacting the shale oil with quadrolobe alumina with or without a processing gas such as hydrogen or nitrogen at 500° F. to 800° F. at 250 to 750 psig and LHSV of 0.4 to 3.0 to deposit a portion of said trace metal onto said alumina and recover an oil product having substantially reduced amounts of trace metal.

20 Claims, 2 Drawing Figures

SHALE OIL DEMETALLIZATION PROCESS

BACKGROUND OF THE INVENTION

1. Field of the Invention

The present invention relates to the treatment of shale oil for the removal of trace metals therefrom, in particular, arsenic, iron and nickel, using a particular alumina contact structure.

2. Related Art

Shale oils produced by the various retort systems contain small amounts of metal contaminates, which in so far as further processing or use are detrimental. For example, further treatment of the shale oil crudes in the various catalytic refinery processes containing the metal contaminates can substantially shorten the life of the catalyst. Serious environmental hazards can also arise if, for example, the arsenic is not reduced to the lowest possible levels.

The removal of arsenic and other trace metals has been proposed by several methods. Generally, these are heat soaking or visbreaking, catalytic contact, and thermal treating in non catalytic packing.

Heat soaking involves heating the oil long enough to form a suspended precipitate which must be subsequently separated by mechanical means.

Catalytic methods involve contacting the shale oil with a catalyst such as oxides or sulfides of nickel, cobalt or iron at elevated temperatures and usually under partial hydrogen pressure.

Thermal treating involves contacting the oil with a non catalytic packing with or without partial hydrogen pressure to deposit all or a portion of the trace metal contaminates on the packing.

Numerous variations of these procedures and various combinations have been proposed for demetallization of carbonaceous oils, including shale oil to obtain safe and industrially acceptable amounts of the metals.

Several patents have been issued on the demetallization of shale oils and other liquids. U.S. Pat. No. 4,046,674 describes a process for specifically removing As from mineral oil feedstocks containing at least 2 ppm As by reacting the oil at 450°-700° F. and 50-5000 psig in the presence of $H_2$ with a catalyst consisting of 30-70% NiS of $MoS_2$ on a refractory oxide. This patent teaches removing at least 1.5 pounds of As per pound of metal on the catalyst.

U.S. Pat. Nos. 3,804,750; 3,876,530; 3,876,533; 3,898,155; 3,954,603; 4,003,829; 4,051,022; and 4,212,729 all disclose removing metals (some disclose removing As specifically and some mention only V, Ni and Fe as they relate to heavy residual demetallization) from various oils using aluminas loaded with at least one of Ni, Mo, Mn or W.

U.S. Pat. No. 4,188,280 discloses removing soluble As and Fe compounds from shale oil with or without added $H_2$ with a porous solid contact material at 149°-510° C. and 50-3000 psig total pressure. This patent discloses reducing As and Fe levels both to less than 1 ppm from shale oils containing more than 4 ppm soluble As and 10 ppm soluble Fe.

U.S. Pat. No. 3,933,624 discloses that As and Fe specifically can be removed from synthetic oils by mixing the crude oil feed with particles of either Fe, Co, or Ni in the form of oxides or sulfides in the presence of $H_2$ at 300° F. and 500 psig. This forms a slurry which is removed from the oil.

U.S. Pat. No. 4,029,571 discloses that As can be removed from synthetic oils by heating to 750°-850° F. forming a precipitate which is then filtered.

U.S. Pat. No. 4,075,085 discloses that As can be removed from hydrocarbon feedstocks by mixing oil with oil-soluble Ni, Co or Cu-containing additives at 300° F., forming an As-containing precipitate which is then filtered.

U.S. Pat. No. 4,141,820 discloses the removal of arsenic from hydrocarbon oil using a solid refractory oxide of a group II, III, or IV element of the Periodic Table, by contacting the oil and hydrogen gas with the solid at 200° to 500° C., the solid having a surface area of 10 $m^2$/gram or more and pore size of about 40 Angstroms to 1000 Angstroms.

An examination of the volume of art in this general area will show very little concern, if any, is directed to the particular form of the contact structure (catalytic or non-catalytic). For example, in U.S. Pat. Nos. 3,804,750 and 4,051,022 the catalyst is taught to be in any physical form, including powders, pellets, granules, spheres, flakes, cylinders, and the like; in U.S. Pat. No. 4,075,085 a packing material is taught to be alundum balls, quartz chips, siliceous gravels, alumina pellets, Rashcig rings and the like; U.S. Pat. No. 3,876,533 teaches the guard bed is composed of pellets or particles of any shape; and U.S. Pat. No. 4,046,674 teaches a catalyst which is extruded as a trilobe.

Bruijn, Naka and Sonnemans investigated the effect of catalyst shape of extruded hydrodesulfurization catalyst in "Ind. Eng. Chem. Process Des. Dev.", 1981, Vol. 20, No. 1, pages 40-45. Their conclusion was that the activity of noncylindrical extrudates may be higher than cylindrical particles because it permits the use in the catalyst bed of smaller particle size at an equal pressure drop.

It is an advantage of the present invention that over 90% of arsenic and iron may be removed from crude shale oil. It is a further advantage that either hydrogen or nitrogen or neither may be present during the process to produce excellent results. It is a feature of the present invention that the contact material which provides such superior removal of arsenic and iron (and nickel to a lesser extent) also provides low pressure drops in the reactor and excellent flow characteristics. These and other advantages and features will beome apparent from the following description.

SUMMARY OF THE INVENTION

It has been found that crude shale oil containing trace amounts of a metal selected from the group consisting of arsenic, iron, nickel and mixtures thereof, contacted at a temperature in the range of 500° F. to 800° F. with a polylobe alumina, preferably quadrolobe alumina with or without hydrogen or nitrogen, removes a substantial portion of the arsenic, iron and nickel from the shale oil.

The term "trace amount" as used herein is understood to mean an amount up to about 300 ppm by weight of said metal. The polylobes include, for example, quadrolobes, pentalobes and hexalobes. The term "polylobe" as used herein means three or more lobes.

DETAILED DESCRIPTION OF THE INVENTION

Figure 1:
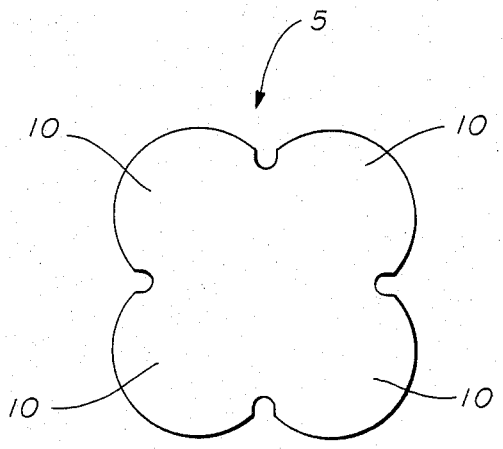
FIG. 1 shows a symmetrical quadrolobe extrudate.

Feed to the present process is described as a shale oil, i.e., a synthetic crude derived by retorting kerogen containing shale, and harmful trace amounts of arsenic, iron and/or nickel are ordinary components thereof. However, the present process will operate to remove these trace metals in hydrocarbonaceous oils regardless of the source and such oils are included within the scope of the term shale oil for that purpose.

Normally crude shale oil contains from about 20 to 30 ppm (wt) arsenic which is in a soluble form. The degree of arsenic removal for the present process will decline as the amount of arsenic drops below 20 ppm, however, it will be proportionally better than other systems. Similarly for the other specified trace metals, the effectiveness of the removal will decline as the amount of trace metal declines. This is a bulk treatment phenomenon and the effective minimum amount of trace metal, i.e., that amount where treatment will give a reduced percent of removal not commensurate with the cost of removal would have to be determined for each metal. For example, in the shale oil retort feeds used to evaluate the present process, the iron content was 97.5 ppm and 156 ppm respectively (typical analysis) and the percent removal was high and substantially the same for both streams, indicating that some level below 97.5 ppm would result in a possible diminished removal. However, on this same basis it would appear that the nickel content of around 10 ppm is below the level where a high percentage, e.g., over 90% of the material would be removed. Notwithstanding, the present process has demonstrated that at whatever level of trace metal, it is superior to processes using other structural forms of alumina.

The metals, As, Fe, and Ni, were removed from shale oils in a trickle-bed reactor using inert aluminas (both the invention and the comparative tests). The optimum removals for the present invention were at 700° F. and 750 psig. The present demetallization process was shown to be independent of pressure in the range 250–750 psig but sharply dependent on temperature with removals increasing with temperature in the range 500°–700° F. The use of $H_2$ provided only a modest advantage over $N_2$ as a process gas. No gas flow at all to the reactor provided the same high metal removal levels as those runs which used $H_2$. Alumina quadrolobes (1/16") gave superior demetallization with the optimum removals being 99.1% As, 99.4% Fe and 80% Ni which correspond to product metal levels of 0.24 ppm As, 0.8 ppm Fe and 2.3 ppm Ni. Removals of at least 93% As, 93% Fe and 80% Ni have been achieved over at least 700 hours on-stream time.

It is proposed as a mechanism, and not by way of limitation, that if the demetallization is diffusion controlled, the considerably lower diffusion resistance found for quadrolobes compared to other forms of inert contacts may account for the superior results.

The preferred pressure for operation is in the range of 250 to 750 psig, however, the system can be operated at pressures in the range of 50 to 5000 psig and obtain much of the benefit as described.

The hydrogen or nitrogen, if any, is preferably fed to the treatment vessel rather than upstream to avoid problems noted in the prior art, i.e., hydrogen may tend to encourage thermal precipitation of trace metals, which may plug feed lines. The use of nitrogen instead of hydrogen, lowers arsenic and iron removals by less than 10% absolute and has no effect on nickel removal. The use of no process gas provided substantially the same product metal levels as hydrogen. This indicates that metal removal according to the present invention is predominantly thermal, which is consistent with the observed absence of significant pressure dependence. The processing gas, if any, may be hydrogen or nitrogen and may be present at a partial pressure of 50 to 5000 psig.

The residence time of the shale oil in contact with the quadrolobe alumina has not been found to be critical, however, at liquid hourly space velocity of over about (LHSV) 3.0, a significant drop in removal is observed and a preferred range of LHSV is 0. to 2.0.

The trace metals are deposited from the oil on to the quadrolobe alumina, as metals.

The alumina employed in the present invention is unmodified $Al_2O_3$ prepared in the conventional manner. The particular form (eta, gamma, beta) is not critical since the alumina serves as a contact structure rather than a catalyst. The polylobes, e.g., the quadrolobes (also known as four lobe) are obtained by extruding the alumina as a paste through an appropriate die. There may be conventional binders present, which are usually removed during the drying and/or calcining of the extruded particles. In a preferred embodiment quadrolobes are employed as the contact structure.

In FIG. 1 a symmetrical quadrolobe extrudate 5 is depicted, wherein each of the lobes 10 has substantially the same size and configuration.

Figure 2:
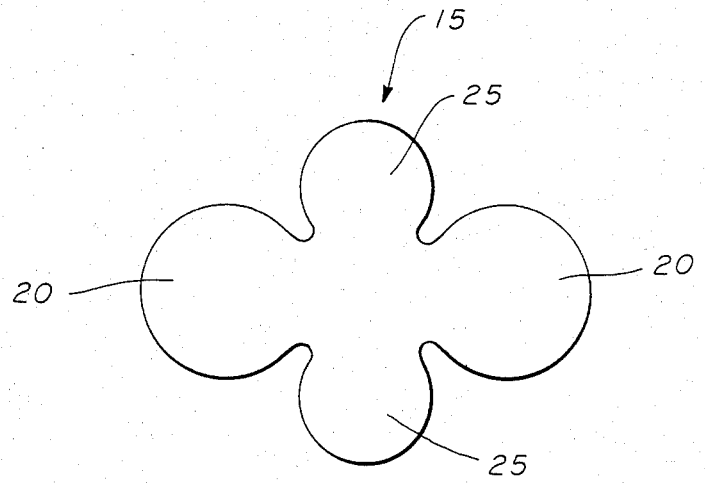
FIG. 2 shows an asymmetrical quadrolobe extrudate.

FIG. 2 shows an asymmetrical quadrolobe 15 wherein adjacent lobes 20 and 25 are dissimilar. The average pore volume of the alumina quadrolobes is in the range of 0.5 and 1.2 cubic centimeters per gram and surface area in the range of 120 to 250 square meters per gram. Generally quadrolobes of 1/32–$\frac{1}{4}$ inch diameter would be used depending on the desired pressure drop through the contact vessel.

A particular advantage of the present invention is the heavy metal loading obtained on the polylobes. For example, using symmetrical 1/16 inch quadrolobes, 28 weight % of metal loading was obtained based on the weight of alumina (in a 700 hour life study carried out at 700° F., 750 psig, LHSV 1, H/oil=1000 SCF/bbl).

In practice the method of the present invention would be used by placing a contact vessel containing a bed of the quadrolobes up stream of a reactor where the shale oil were to be treated in some manner, so as to serve as a guard bed.

EXAMPLES

All runs were performed in a $\frac{3}{4}$"×28" trickle-bed reactor heated by a 4-zone electric furnace with each zone 5" in length. The reactor was typically charged with about 90 $cm^3$ of alumina (approximately 8" bed). Preheat and postheat zones (each 8") were also placed in the reactor. After each change of conditions, 24 hours was allowed for reactor lineout prior to liquid sampling. Both bed temperatures (continuously monitored by a sliding thermocouple) and gas flow rates (metered by a mass flow controller) were controlled to within 0.5% of the target values. The reactor effluent liquid was collected in a high-pressure vapor-liquid separator and the liquid was analyzed for metals using either a Perkin-Elmer model 4000 or 5000 atomic absorption spectrophotometer.

The properties of the shale oil feedstocks metered to the trickle-bed reactor are listed in Table I. The physical properties of the aluminas used in this study are summarized in Table II. The quadrolobes used in the examples were symmetrical.

EXAMPLE 1

Feed B was run with the quadrolobe alumina as described, at various temperatures and pressures. All runs were at LHSV=0.90, v/v/hr. and $H_2$/oil=1000 SCF/bbl. The results are reported in Table III.

EXAMPLE 2

Feed A was run for 183 hours with the quadrolobe alumina under the following conditions: 700° F., 750 psig LHSV=1.0 v/v/hr, $H_2$oil=1000 SCF/bbl. The results are reported in Table IV.

EXAMPLE 3

For comparison, Example 2 was repeated using the same feed and conditions and Katalco 81-6711 as the contact surface. The results are reported in Table V. It can be seen by comparing the results of Table IV and Table V that the quadrolobes provide substantially better metal removal.

TABLE I

SHALE OIL FEEDSTOCK PROPERTIES

| | Feed A | Feed B |
|---|---|---|
| As, ppm | 23.8 | 24.0 |
| Fe, ppm | 97.5 | 156.0 |
| Ni, ppm | 8.0 | 9.8 |
| V, ppm | <1 | <1 |
| S, Wt. % | 0.71 | 0.75 |
| N, Wt. % | 2.12 | 1.30 |
| Sp. Gr. (60/60° F.) | 0.92 | 0.92 |
| °API | 22.5 | 22.5 |
| Pour Point, °F. | 50 | −15 |

TABLE II

ALUMINA PHYSICAL PROPERTIES

| | Katalco 81-6711 | Katalco 81-6712 | Armak 07-151 | Harshaw A1-4126E |
|---|---|---|---|---|
| Shape | Sphere | Sphere | Quadrolobe | Cylinder |
| Diameter, in. | 1/16 | 1/16 | 1/16 | 1/16 |
| Surface Area, sq. m/g. | 265 | 220 | 169 | 230 |
| Pore Volume, cu. cm/g. | 0.78 | 1.1 | 0.73 | 0.78 |
| Compacted bulk density, g/cu. cm. | 0.50 | 0.36 | 0.57 | 0.45 |
| Average pore diameter, Angstroms | 124 | 147 | 173 | 136 |

TABLE III

| T, °F. | P, psig | Gas | Hrs. On Stream | As Prod, ppm | As % rem | Fe Prod, ppm | Fe % rem | Ni Prod, ppm | Ni % rem |
|---|---|---|---|---|---|---|---|---|---|
| 500 | 250 | $H_2$ | 20 | 15.8 | 34.2 | 48 | 69.2 | 9.5 | 3.1 |
| 600 | 250 | $H_2$ | 45 | 10.5 | 56.3 | 34 | 78.2 | 4.8 | 51.0 |
| 700 | 250 | $H_2$ | 69 | 0.97 | 96.0 | 11.9 | 92.4 | 2.5 | 74.5 |
| 700 | 500 | $H_2$ | 93 | 0.70 | 97.1 | 5.6 | 96.4 | 2.2 | 77.6 |
| 700 | 750 | $H_2$ | 119 | 0.75 | 96.9 | 12.0 | 92.3 | 1.6 | 83.7 |
| 700 | 750 | None | 142 | 0.50 | 97.9 | 10.5 | 93.3 | 2.4 | 75.5 |
| 700 | 750 | $H_2$ | 167 | 0.70 | 97.1 | 8.1 | 94.8 | 2.8 | 71.4 |
| 700 | 750 | $H_2$ | 190 | 2.6 | 89.2 | 15.3 | 90.2 | 2.8 | 71.4 |
| 700 | 750 | $H_2$ | 220 | 1.5 | 93.8 | 13.0 | 91.7 | 1.7 | 82.7 |
| 700 | 750 | $H_2$ | 244 | 1.6 | 93.3 | 16.8 | 89.2 | 1.9 | 80.6 |
| 700 | 750 | $H_2$ | 268 | 1.7 | 92.9 | 11.5 | 92.6 | 2.2 | 77.6 |
| 700 | 750 | $H_2$ | 292 | 1.7 | 92.9 | 11.5 | 92.6 | 2.2 | 77.6 |
| 700 | 750 | $H_2$ | 500 | 1.5 | 95.0 | 13.8 | 93.4 | 1.3 | 87.0 |

EXAMPLE 4

This example compares the three catalysts run at 700° F., 750 psig, LHSV=1.0 v/v/hr, $H_2$/oil=1000 SCF/bbl. after 100 hours on stream using Feed A. The results are set out in Table VI. Again the superior removal of trace metals is shown for the quadrolobe alumina. An additional run for Feed B with the quadrolobes is also shown, which was carried out under the same conditions. It should be noted that both of Armak 07-151 runs shown in Table VI were terminated before the systems had come to equilibrium and substantially better results have been obtained on longer runs. This is illustrated in Table VII where a cylindrical catalyst is compared with the quadrolobe, both of which having reached equilibrium and no further time trend improvement being observed.

The conditions of the treatment in Table VII were the same as the other runs in this example. The feed was the B feed from different lots, and some variation in metals analysis was observed (noted on Table VII), however, the variation in metal analyses on the observed feeds does not produce any significant variation in the performance of the contact structures.

TABLE IV

| Hrs. On Stream | As Prod, ppm | As % rem | Fe Prod, ppm | Fe % rem | Ni Prod, ppm | Ni % rem |
|---|---|---|---|---|---|---|
| 22 | 0.88 | 96.3 | 2.9 | 97.0 | 7.6 | 5.0 |
| 114 | 0.88 | 96.3 | 3.4 | 96.5 | 4.4 | 45.0 |
| 165 | 0.88 | 96.3 | 3.2 | 96.7 | 4.4 | 45.0 |
| 183 | 0.75 | 96.8 | 1.3 | 98.7 | 4.7 | 41.3 |

TABLE V

| Hrs. On Stream | As Prod, ppm | As % rem | Fe Prod, ppm | Fe % rem | Ni Prod, ppm | Ni % rem |
|---|---|---|---|---|---|---|
| 26 | 2.6 | 89.1 | 24.4 | 75.0 | 6.4 | 20.0 |
| 104 | 1.9 | 92.0 | 15.6 | 84.0 | 6.9 | 13.8 |
| 121 | 2.0 | 91.6 | 16.6 | 83.0 | 6.6 | 17.5 |
| 144 | 1.8 | 92.4 | 16.3 | 83.3 | 5.9 | 26.3 |
| 146 | 1.8 | 92.4 | 11.9 | 87.8 | 5.8 | 27.5 |
| 196 | 1.9 | 92.0 | 24.1 | 85.3 | 6.1 | 23.8 |

TABLE VI

| | As | | Fe | | Ni | |
|---|---|---|---|---|---|---|
| | Prod, ppm | % rem | Prod, ppm | % rem | Prod, ppm | % rem |
| FEED A | | | | | | |
| Katalco 81-6711 | 1.8 | 92.4 | 11.9 | 87.8 | 5.8 | 27.5 |
| Katalco 81-6712 | 1.9 | 92.4 | 22.8 | 76.6 | 5.4 | 32.5 |
| Armak 07-151 | 0.75 | 96.8 | 1.3 | 98.7 | 4.4 | 45.0 |
| FEED B | | | | | | |
| Armak 07-151 | 0.70 | 97.1 | 8.1 | 94.8 | 2.8 | 71.0 |

TABLE VII

| | As | | Fe | | Ni | |
|---|---|---|---|---|---|---|
| | prod, ppm | % rem | prod, ppm | % rem | prod, ppm | % rem |
| HARSHAW AL-4126E | 4.2 | 79.3 | 32.0 | 77.0 | 3.6 | 68.7 |
| ARMAK 07-151 | 0.24 | 99.1 | 0.8 | 99.4 | 2.3 | 80.0 |
| Feed Analyses: | | | | | | |
| Harshaw run: | 20.3 ppm As, 139.1 ppm Fe, 11.5 ppm Ni | | | | | |
| Armak run: | 19.0 ppm As, 131.3 ppm Fe, 10.9 ppm Ni | | | | | |

The invention claimed is:

1. The method of removing trace metals from a hydrocarbonaceous oil comprising, (a) contacting a hydrocarbonaceous oil containing trace amounts of a metal selected from the group consisting of As, Fe, Ni and mixtures thereof with a bed of polylobe contact structures consisting essentially of unmodified alumina at a temperature in the range 500° F. to 700° F., and (b) recovering said hydrocarbonaceous oil having a substantial portion of said trace metal removed from said oil wherein said method is characterized in that the presence or absence of hydrogen or nitrogen process gas produces substantially the same level of trace metal removal.

2. The method according to claim 1 wherein said hydrocarbonaceous oil is shale oil.

3. The method according to claim 2 wherein said polylobe is quadrolobe.

4. The method according to claim 2 wherein said trace metal is a mixture of As, Fe and Ni.

5. The method according to claim 4 wherein at least 20 ppm As are present in said oil initially.

6. The method according to claim 1 wherein the pressure during said contacting is in the range of 250 to 750 psig.

7. The method according to claim 1 wherein hydrogen and nitrogen process gas are absent during said contacting.

8. The method according to claim 1 wherein hydrogen is present during said contacting.

9. The method according to claim 1 wherein nitrogen is present during said contacting.

10. The method according to claim 1 wherein the LHSV is in the range of 0.4 to 3.0.

11. The method of removing trace metals from a shale oil comprising (a) contacting a shale oil containing trace amounts of a metal selected from the group consisting of As, Fe, Ni and mixtures thereof in a reactor with a fixed bed of quadralobe contact structures consisting essentially of unmodified alumina at a temperature of 500° F. to 700° F. at a pressure in the range of 50 to 5000 psig and LHSV in the range of 0.4 to 3.0 to thereby deposit a portion of said trace metal on to said quadralobe, and (b) recovering said shale oil having a substantial portion of said trace metal removed therefrom wherein said method is characterized in that the presence or absence of hydrogen or nitrogen process gas produces substantially the same level of trace metal removal.

12. The method according to claim 11 wherein up to about 300 ppm of said trace metal is present in said shale oil on contacting said quadrolobe alumina.

13. The method according to claim 12 wherein at least 20 ppm As are present in said shale oil on said contacting.

14. The method according to claim 13 wherein As, Fe and Ni are present in said shale oil.

15. The method according to claim 14 wherein said pressure is in the range of 250 to 750 psig.

16. The method according to claim 15 wherein said quadrolobes are from 1/32 to ¼ inch diameter.

17. The method according to claim 16 wherein said quadrolobes have an average pore volume in the range of 0.5 to 1.2 cubic centimeters per gram.

18. The method according to claim 16 wherein hydrogen and nitrogen process gas are absent during said contacting.

19. The method according to claim 16 wherein said contacting is in the presence of hydrogen.

20. The method according to claim 16 wherein said contacting is in the presence of nitrogen.

* * * * *

UNITED STATES PATENT AND TRADEMARK OFFICE

CERTIFICATE OF CORRECTION

PATENT NO. : 4,534,855
DATED : 8/13/85
INVENTOR(S) : Silverman

It is certified that error appears in the above-identified patent and that said Letters Patent is hereby corrected as shown below:

Col. 1, Line 16 reads " contaminates" but should read --- contaminants ---

Col. 1, Line 35 reads "contaminates" but should read --- contaminants ---

Col. 3, Line 7 reads "nickel are ordinary" but should read --- nickel which are ordinary ---

Col. 5, Line 16 reads "$H_2$oil" but should read --- $H_2$/oil ---

Signed and Sealed this

Sixteenth Day of December, 1986

*Attest:*

DONALD J. QUIGG

*Attesting Officer* *Commissioner of Patents and Trademarks*